United States Patent [19]

Yee-Kwong

[11] Patent Number: 5,065,148

[45] Date of Patent: Nov. 12, 1991

[54] LCD DRIVER A GENERATOR

[75] Inventor: Timothy K. Yee-Kwong, Hong Kong, Hong Kong

[73] Assignee: Motorola, Inc., Schaumburg, Ill.

[21] Appl. No.: 387,561

[22] Filed: Jul. 31, 1989

[51] Int. Cl.[5] ..... G09G 3/36

[52] U.S. Cl. ..... 340/784; 359/55

[58] Field of Search ..... 340/784, 765; 350/332, 350/333

[56] References Cited

U.S. PATENT DOCUMENTS 3,765,747 10/1973 Pankratz et al. ..... 340/719

4,271,410 6/1981 Crawford ..... 340/765

4,773,716 9/1988 Nakanowatari ..... 340/784

4,921,334 5/1990 Akodes ..... 340/784

*Primary Examiner*—Ulysses Weldon

*Assistant Examiner*—Doon Yue Chow

*Attorney, Agent, or Firm*—Charles R. Lewis; Eugene A. Parsons

[57] ABSTRACT

A method of providing IC layouts for a family of LCD drivers including the steps of separating the driver into a front end section and a driver section, determining the number of backplanes and frontplanes and the number and size of voltage levels required, generating a resistor ladder voltage generator with the required number and size of levels, generating individual cell layouts for each of the major components, and building pitch matched layouts of the components from the cells.

8 Claims, 19 Drawing Sheets

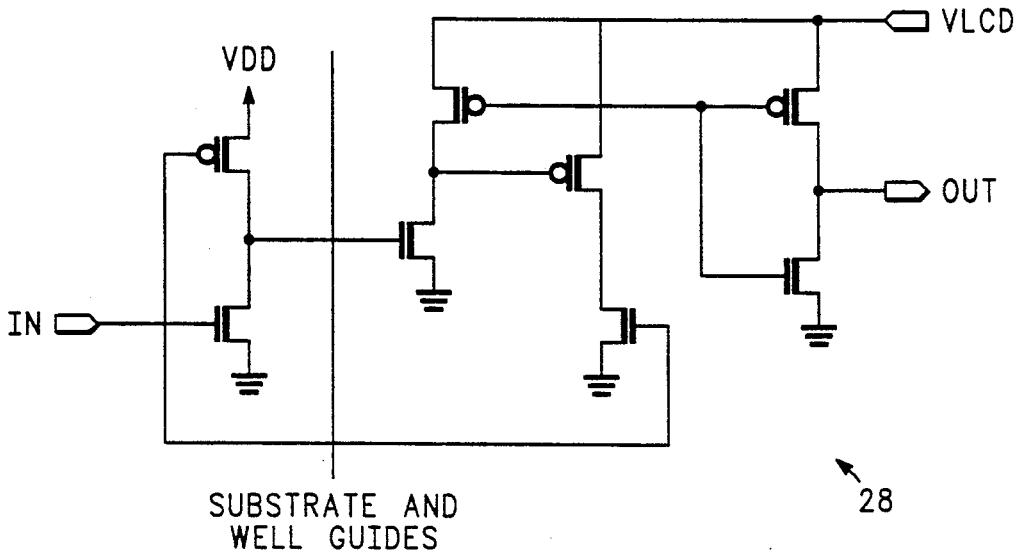
FIG. 2
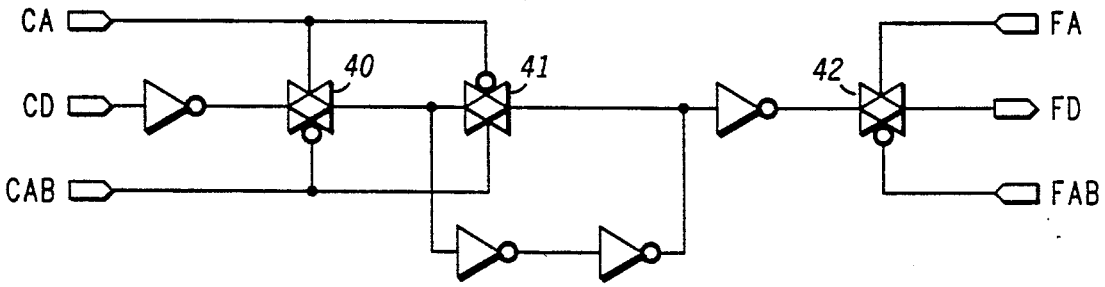
FIG. 5
FIG. 11
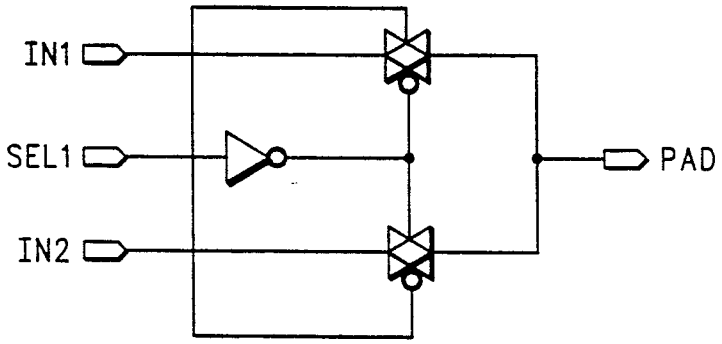

| AB | DBI7 | DBI6 | DBI5 | DBI4 | DBI3 | DBI2 | DBI1 | DBI0 |
|---|---|---|---|---|---|---|---|---|
| 000 | FP0 BP7 | FP0 BP6 | FP0 BP5 | FP0 BP4 | FP0 BP3 | FP0 BP2 | FP0 BP1 | FP0 BP0 |
| 001 | FP1 BP7 | FP1 BP6 | FP1 BP5 | FP1 BP4 | FP1 BP3 | FP1 BP2 | FP1 BP1 | FP1 BP0 |
| 010 | FP2 BP7 | FP2 BP6 | FP2 BP5 | FP2 BP4 | FP2 BP3 | FP2 BP2 | FP2 BP1 | FP2 BP0 |
| 011 | FP3 BP7 | FP3 BP6 | FP3 BP5 | FP3 BP4 | FP3 BP3 | FP3 BP2 | FP3 BP1 | FP3 BP0 |
| 100 | FP4 BP7 | FP4 BP6 | FP4 BP5 | FP4 BP4 | FP4 BP3 | FP4 BP2 | FP4 BP1 | FP4 BP0 |
| 101 | FP5 BP7 | FP5 BP6 | FP5 BP5 | FP5 BP4 | FP5 BP3 | FP5 BP2 | FP5 BP1 | FP5 BP0 |
| ... | ... ... | ... ... | ... ... | ... ... | ... ... | ... ... | ... ... | ... ... |

*FIG. 4A*

*FIG. 4B*

MEMORY MAP FOR 4-BACKPLANES

| AB | DBI7 | DBI6 | DBI5 | DBI4 | DBI3 | DBI2 | DBI1 | DBI0 |
|---|---|---|---|---|---|---|---|---|
| 000 | FP1 BP3 | FP1 BP2 | FP1 BP1 | FP1 BP0 | FP0 BP3 | FP0 BP2 | FP0 BP1 | FP0 BP0 |
| 001 | FP3 BP3 | FP3 BP2 | FP3 BP1 | FP3 BP0 | FP2 BP3 | FP2 BP2 | FP2 BP1 | FP2 BP0 |
| 010 | FP5 BP3 | FP5 BP2 | FP5 BP1 | FP5 BP0 | FP4 BP3 | FP4 BP2 | FP4 BP1 | FP4 BP0 |
| 011 | FP7 BP3 | FP7 BP2 | FP7 BP1 | FP7 BP0 | FP6 BP3 | FP6 BP2 | FP6 BP1 | FP6 BP0 |
| 100 | FP9 BP3 | FP9 BP2 | FP9 BP1 | FP9 BP0 | FP8 BP3 | FP8 BP2 | FP8 BP1 | FP8 BP0 |
| 101 | FP11 BP3 | FP11 BP2 | FP11 BP1 | FP11 BP0 | FP10 BP3 | FP10 BP2 | FP10 BP1 | FP10 BP0 |
| ... | ... ... | ... ... | ... ... | ... ... | ... ... | ... ... | ... ... | ... ... |

| AB | DBI7 | DBI6 | DBI5 | DBI4 | DBI3 | DBI2 | DBI1 | DBI0 |
|---|---|---|---|---|---|---|---|---|
| 000 | FP3 BP1 | FP3 BP0 | FP2 BP1 | FP2 BP0 | FP1 BP1 | FP1 BP0 | FP0 BP1 | FP0 BP0 |
| 001 | FP7 BP1 | FP7 BP0 | FP6 BP1 | FP6 BP0 | FP5 BP1 | FP5 BP0 | FP4 BP1 | FP4 BP0 |
| 010 | FP11 BP1 | FP11 BP0 | FP10 BP1 | FP10 BP0 | FP9 BP1 | FP9 BP0 | FP8 BP1 | FP8 BP0 |
| 011 | FP15 BP1 | FP15 BP0 | FP14 BP1 | FP14 BP0 | FP13 BP1 | FP13 BP0 | FP12 BP1 | FP12 BP0 |
| 100 | FP19 BP1 | FP19 BP0 | FP18 BP1 | FP18 BP0 | FP17 BP1 | FP17 BP0 | FP16 BP1 | FP16 BP0 |
| 101 | FP23 BP1 | FP23 BP0 | FP22 BP1 | FP22 BP0 | FP21 BP1 | FP21 BP0 | FP20 BP1 | FP20 BP0 |
| ... | ... | ... | ... | ... | ... | ... | ... | ... |

LCD DRIVER A GENERATOR

The present invention pertains to the generation of LCD drivers for any of a large variety of applications and more specifically to a novel LCD driver and methods of generation.

BACKGROUND OF THE INVENTION

Liquid crystal displays (LCD's) are common features on consumer products, but different LCD's having different specifications require different numbers of frontplanes and backplanes and may need very different frontplane and backplane driving waveforms. Thus, separate driver circuit designs and physical layouts have to be prepared for each customer specification, usually by a different engineer. This results in an enormous duplication of effort throughout the industry, as well as within individual companies.

SUMMARY OF THE INVENTION

It is an object of the present invention to provide a method of generating LCD driver IC layouts for a large variety of LCD's.

It is a further object of the present invention to provide a new and improved LCD driver.

It is a further object of the present invention to provide a new and improved method of generating LCD driver IC layouts that incorporates the different characteristics of a wide variety of LCD's.

These and other objects are realized in a novel LCD driver and in a method of providing an IC layout for the LCD driver including the steps of selecting a specific type of LCD to be driven, separating the LCD driver module into a front end section including a RAM, address decoder and control logic, and a driver section including frontplane and backplane drivers and a voltage generator, determining the number of backplanes and frontplanes to be included in the RAM, selecting the frame and clock frequencies, determining a number of voltage levels to be generated by the voltage generator using the equation $$\text{"Levels} = 2 + \sqrt{\text{No. of backplanes}}\text{"}$$

and generalizing these voltage levels to six psuedo-voltage levels as defined by:

$$V_0=0$$

$$V_1=V_{lcd}/a$$

$$V_2=2\ V_{lcd}/a$$

$$V_3=(1-2/a)V_{lcd}$$

$$V_4=(1-1/a)V_{lcd}$$

$$V_5=V_{lcd}$$

where a=No. of levels—1, generating a resistor ladder to provide the voltage levels at the right hand side of these equations, generating the layout of a driver cell and building frontplane and backplane drivers from the layout for providing frontplane and backplane, select and non-select square-waves by continually switching between two psuedo-voltage levels as given by: $V_{fps}=V_5/V_0$; $V_{fpns}=V_3/V_2$; $V_{bps}=V_0/V_5$; and $V_{bpns}=V_4/V_1$, and gating these square-waves at the proper times to frontplane and backplane output pads, generating the layout of a RAM cell with a known height and width and building a RAM from the layout of the RAM cell with the required number of cells to provide the selected backplanes and frontplanes, building an address decoder for writing data in the RAM, said address decoder being pitch matched to one of the height and width of the RAM cells, building a control circuit pitch matched to one of the height and width of the RAM cells, and connecting all of the components to produce an LCD driver IC layout.

BRIEF DESCRIPTION OF THE DRAWINGS

Referring to the drawings,

FIG. 2 illustrates schematically one cell of the voltage translator of FIG. 1;

FIGS. 4A, 4B and 4C illustrate memory maps for 8, 4 and 2 backplanes, respectively, in the dual-port buffer RAM of FIG. 1;

FIG. 5 illustrates a RAM cell for use in the dual-port buffer RAM of FIG. 1;

FIG. 11 illustrates schematically a frontplane driver cell for use in the frontplane and backplane drivers of FIG. 1;

FIG. 15 is an illustration of the LCD driver sub-generator calls hierarchy;

DESCRIPTION OF THE PREFERRED EMBODIMENTS

Figure 1:
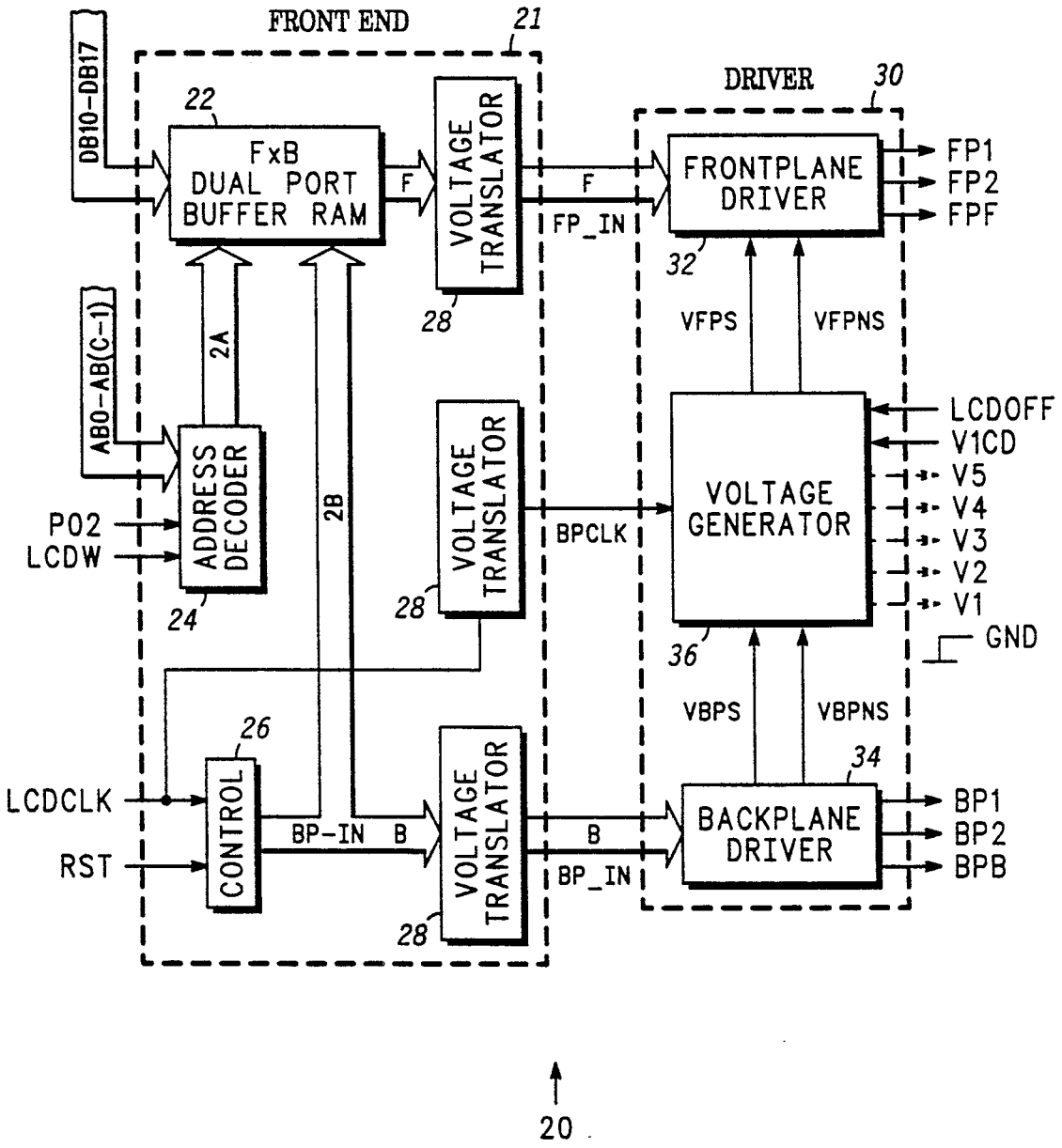
FIG. 1 illustrates an LCD driver block diagram embodying the present invention.

Referring specifically to FIG. 1, a block diagram of an LCD driver 20 embodying the present invention is illustrated. LCD driver 20 is partitioned into a front end section 21, including a dual-port buffer RAM 22, an address decoder 24, control logic circuitry 26 and voltage translators 28, and a driver section 30, including a frontplane driver 32, a backplane driver 34 and a voltage generator 36. In this specific embodiment front end section 21 includes an 8 bit bus for interfacing with an 8 bit microprocessor, such as an MC68HC05 MCU, but front end section 21 can easily be modified to operate in other applications or as a stand-alone chip.

Front end section 21 contains the internal logic circuitry which normally operates at a supply voltage $V_{dd}$ in the range of 3 V to 5 V. A separate supply voltage $V_{lcd}$ in the range of 3 V to 6 V is provided to operate the driver section 30 to obtain optimum display quality. To eliminate potential connection problems between front end section 21 and driver section 30, and also to separate the two different types of semiconductor chip wells with different bias potentials, voltage translators 28 are utilized. Each of the leads connecting dual-port buffer RAM 22, control logic circuitry 26 and an external backplane clock signal, BPCLK, are connected to driver section 30 through voltage translators 28. A single translator cell (one connecting lead) is illustrated schematically in FIG. 2. It is believed that the operation of translator 28 will be clear to those skilled in the art and, accordingly, further operating details will not be described.

The division of LCD driver 20 into front end section 21 and driver section 30 is provided for the following reasons. Front end section 21 serves as the buffer interface to the MCU core while driver section 30 generates and supplies frontplane and backplane waveforms to the LCD unit. This partition reflects very well the actual semiconductor chip layout where front end section 21 is generally a rectangular block, to be internally block-placed in the chip. The circuits of driver section 30 are implemented in the pad area for the following reasons: most transistors in these circuits are large and are connected directly to metal pads so they have the same latch-up and ESD protection requirements as normal pad transistors; and these circuits are operating on $V_{lcd}$, which may not be the same as $V_{dd}$, so their N-wells have to be separated from internal logic. In view of these layout considerations, the border-line is drawn at voltage translators 28, which separates pad-area $V_{lcd}$ voltage area from internal $V_{dd}$ area.

Figure 3A:
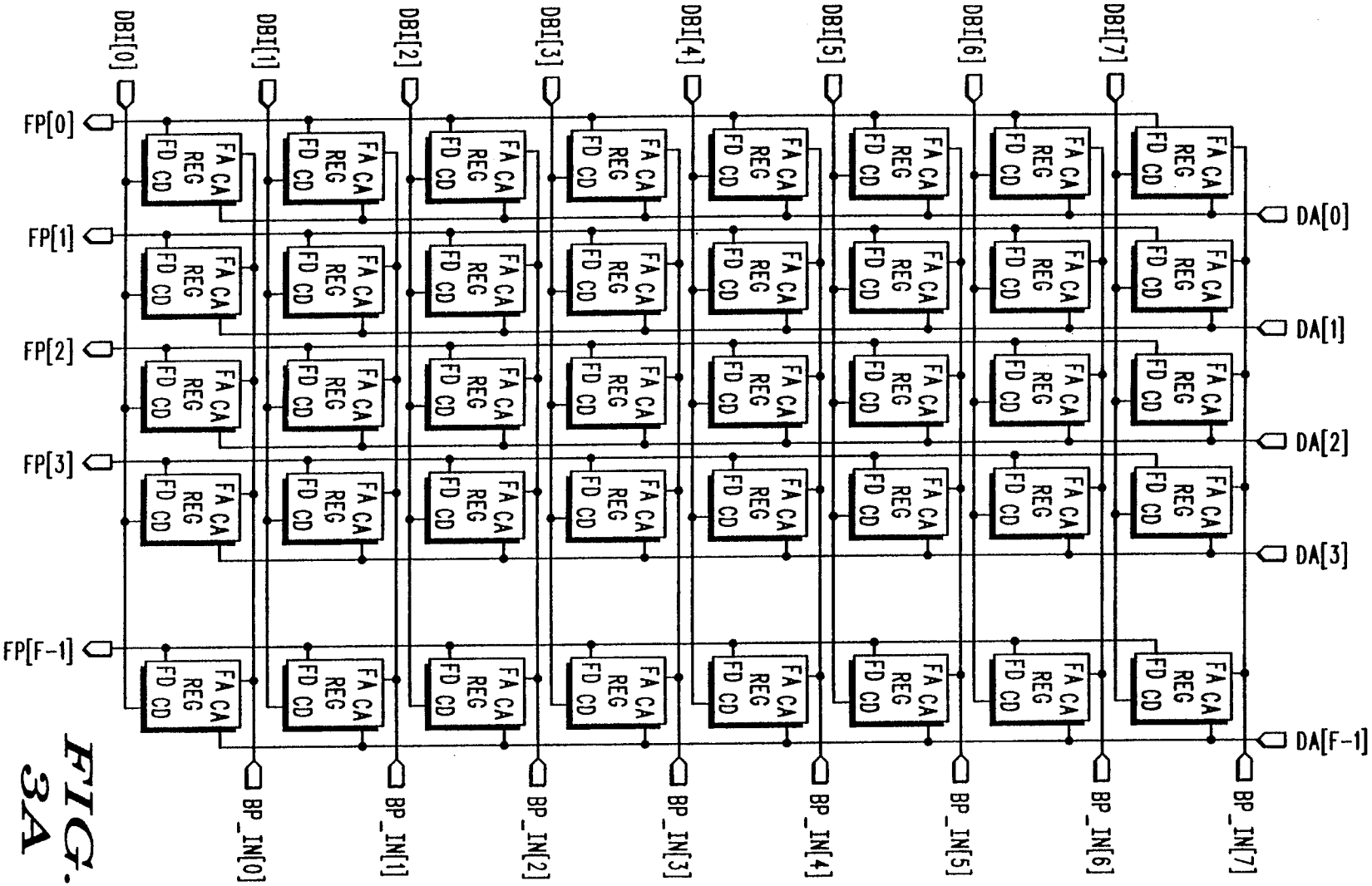
FIGS. 3A and 3B illustrate different configurations for the dual-port buffer RAM of FIG. 1 having 8 and 4 backplanes, respectively.
Figure 3B:
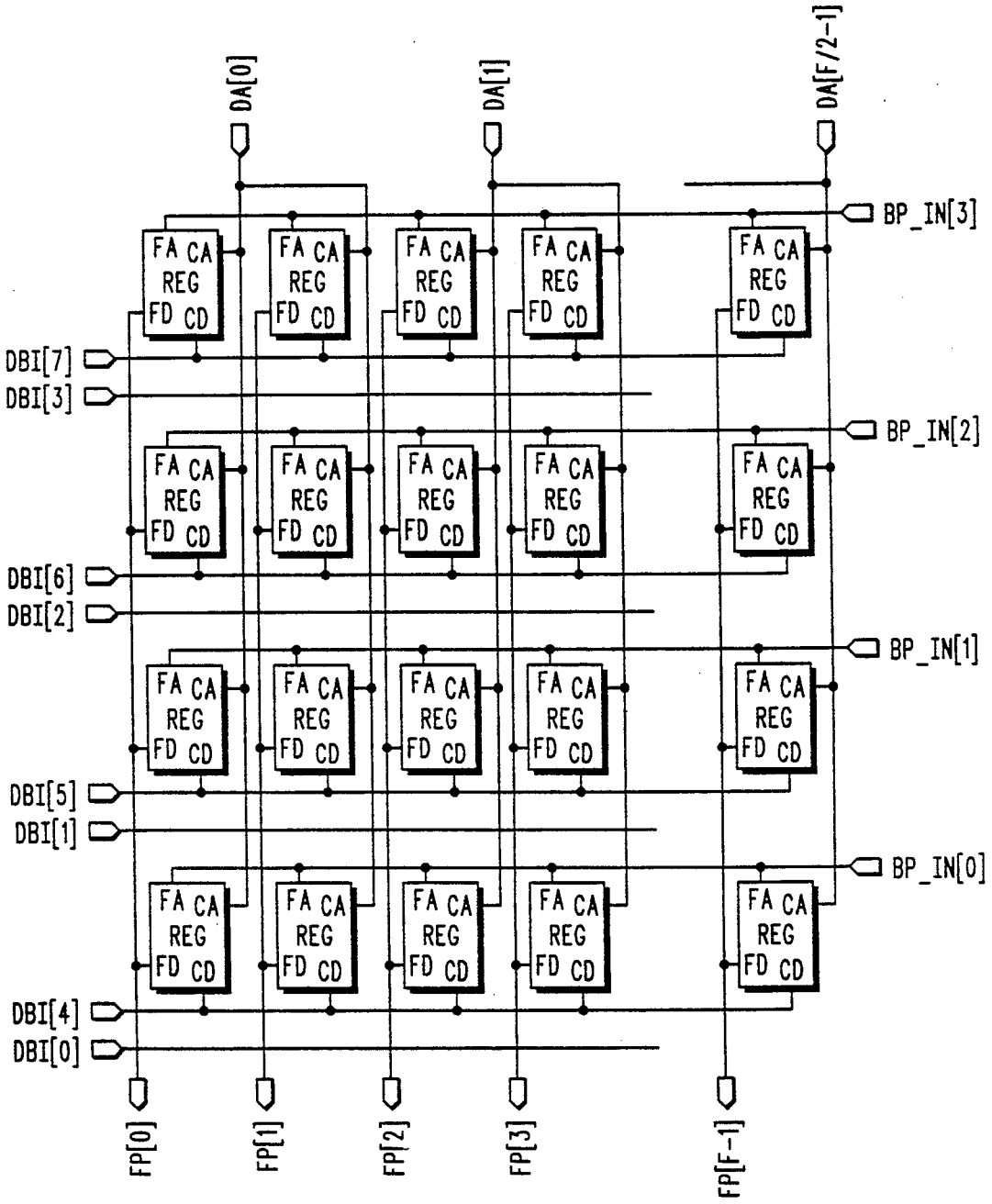
Figures 4C, 15:
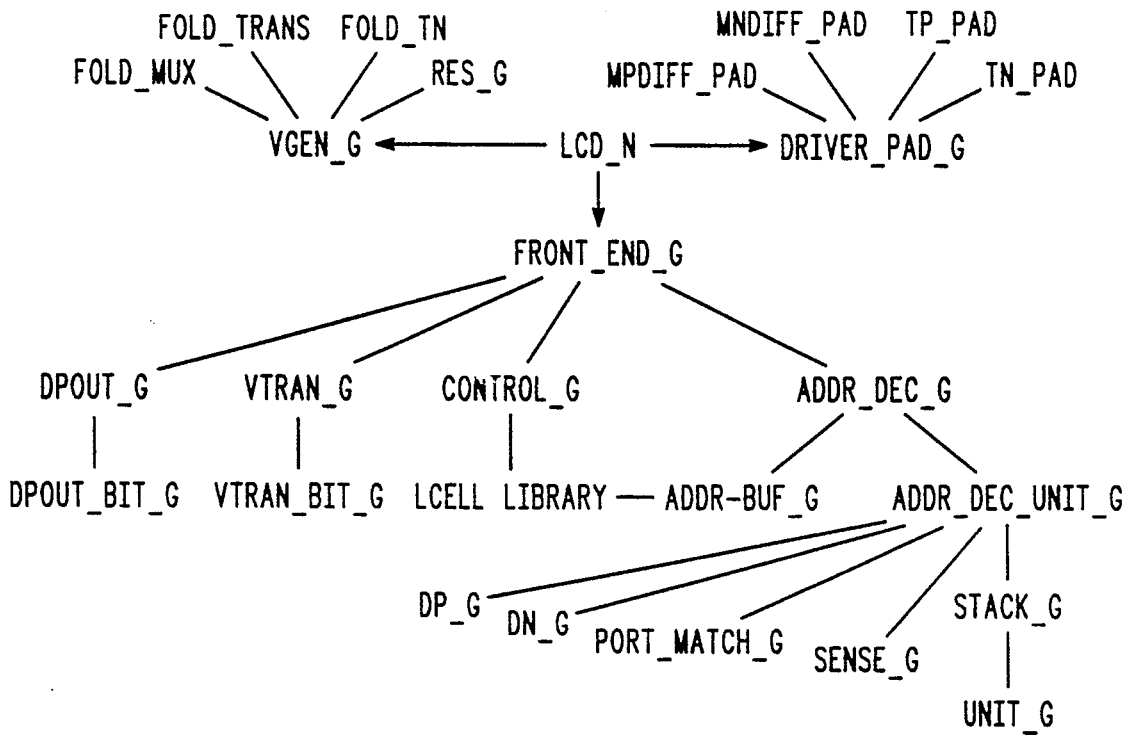

Dual-port buffer RAM 22 is used to store all the LCD picture information. The core data port (DBI0–DBI7) connecting to the MCU is write only, and is 8-bits wide. The read-only frontplane driver port is scanned continuously for display, regardless of the operation on the core port. The frontplane driver bus (FP-IN) is F-bits wide, where F is the number of frontplanes. Both address lines from address decoder 24 and control logic circuitry 26 are not encoded. Dual-port buffer RAM 22 can be generated in a variety of configurations, two of which are illustrated in FIGS. 3A and 3B, for different numbers of backplanes. FIG. 3A is a suitable configuration for dual-port buffer RAM 22 when 8-backplane LCDs are driven and FIG. 3B is a suitable configuration when 4-backplane LCDs are driven. It will of course be understood by those skilled in the art that other configurations are possible for other numbers of backplane in the driven LCDs, for example 2 backplanes will require only two rows of RAM cells. To generate compact layouts as shown in the schematics of FIGS. 3A and 3B, memory maps are carefully planned as illustrated in FIGS. 4A, 4B and 4C. FIG. 4A is a memory map for 8-backplanes. FIG. 4B is a memory map for 4-backplanes. FIG. 4C is a memory map for 2-backplanes. In each of these memory maps FP signifies a frontplane bit, BP signifies a backplane bit, DBI signifies a data bit input and AB signifies the address bits from address decoder 24.

Dual-port buffer RAM 22 is composed of RAM cells, which are buffered d-latches, a schematic of which is illustrated in FIG. 5. As can be seen from FIG. 5, when a write signal (high pulse) is received on input terminal CA (and a low pulse on input terminal CAB) a transmission gate 40 conducts data appearing on input terminal CD to the right (in FIG. 5), and when CA drops to a low voltage (CAB rises to a high voltage) a transmission gate 41 latches the double inverted (for timing) data signal to the left. Thus, the input data is latched into the cell. When a read signal (high pulse) is supplied to input terminal FA (and a low pulse is applied to FAB), an output transmission gate 42 conducts the data signal to a data output terminal FD.

Figure 6:
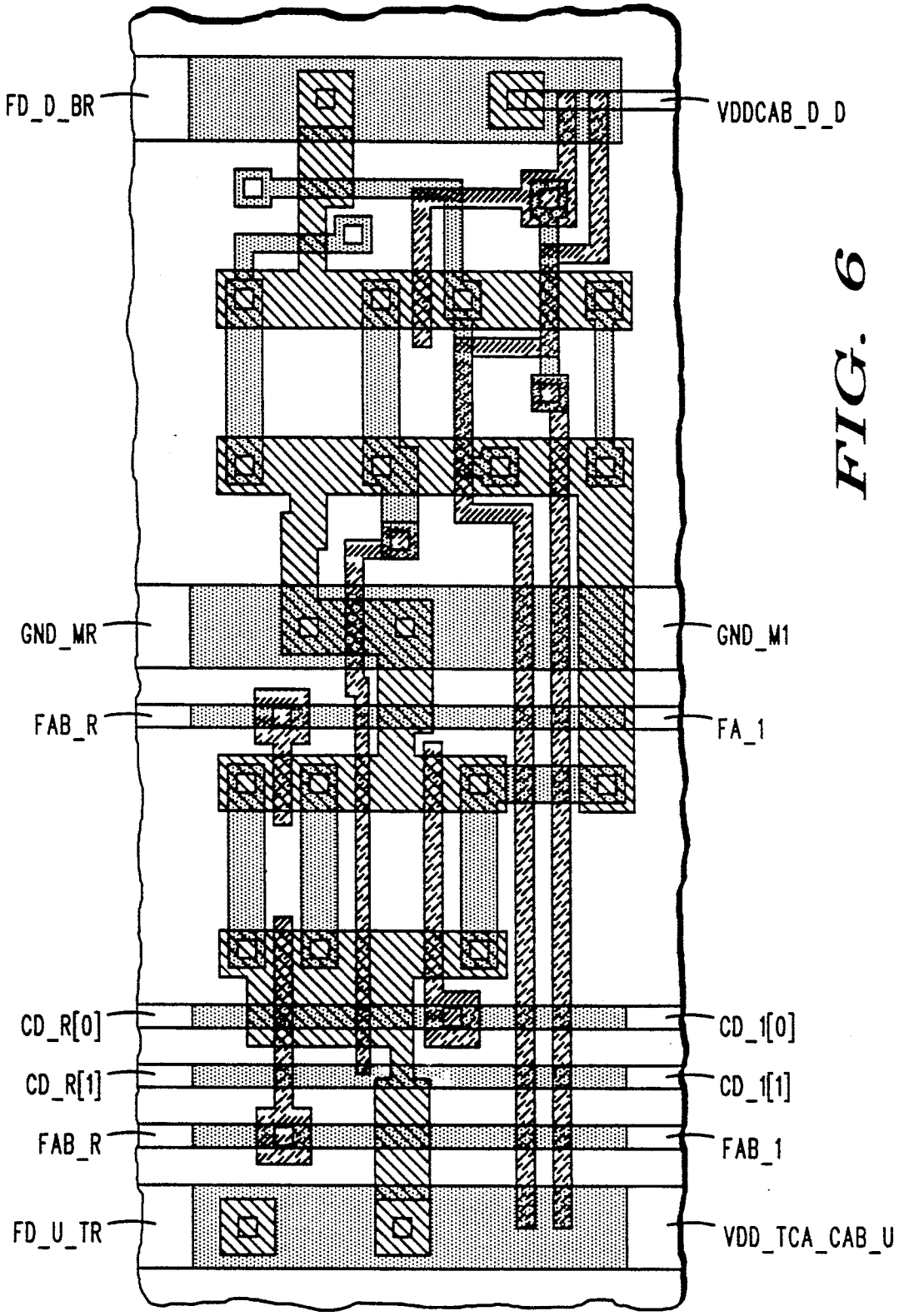
FIG. 6 illustrates an example of a layout in accordance with the present invention of the dual-port RAM cell illustrated in FIG. 5.

It should be noted that the design and layout of dual-port buffer RAM 22 is a good area to take advantage of silicon compiler techniques to generate very compact layouts because of regularity in its structure. A typical dual-port RAM bit-cell layout of the RAM bit-cell illustrated in FIG. 5 and designed in accordance with the specified rules is illustrated in FIG. 6. The methodology to generate dual-port buffer RAM 22 is as follows:

1. First design a dual-port RAM bit-cell layout generator.

2. The cell should be able to abut to itself on four sides with proper signal connections brought out in the vertical and horizontal directions. All of the signal lines of the bit-cell should be accessible on two sides, either vertically or horizontally. See FIG. 6 for an example of this structure.

3. Then create a higher level dual-port buffer RAM generator which in turn calls the dual-port bit-cell sub-generator and assembles the bit-cell instances together.

4. In the actual layout, the bit-cells are physically arranged in a backplanes rows * frontplanes columns configuration. With such a configuration, the maximum number of rows will be fixed at 8, as shown in FIG. 3A. As the cell is targeted first at a single layer metal process, the POLY layer is used for interconnections in the vertical direction. When the size of the dual-port buffer RAM grows, it will only grow horizontally and its parasitic resistance will not increase significantly.

5. To satisfy point 4, the whole dual-port buffer RAM block may have a long and unacceptable aspect ratio, especially if the number of backplanes is small. Therefore, the optimum shape of the RAM cell (illustrated in FIG. 5) is tall and thin. With 3 micron HCMOS III process layout design rules of Motorola Inc. the RAM cell for a 4 backplane dual-port buffer RAM is 72 u * 201 u. With this RAM cell, the entire front end section block has a size of 2200 u * 1200 u, which is a good aspect ratio.

6. Gates of all transistors in the RAM cell are placed in the vertical orientation such that if the transistor size parameters are changed, only the height of the RAM cell is affected while keeping the width at its minimum.

7. As shown in FIGS. 3A and 3B a byte of RAM cells is distributed in 8 or 4 columns in the 8 and 4 backplane situations. To satisfy point 2, feedthru data lines have to be provided inside the RAM cell and a parameter of the RAM cell is used to control which data line the particular RAM cell is tapping.

8. To minimize RAM cell area, the RAM cell has a $V_{dd}$ power bus on the top and bottom thereof and a ground bus in the middle. When the higher level dual-port buffer RAM sub-generator instantiates the RAM cells, it flips alternate rows upside-down so that the power bus and signal lines abut correctly.

Figure 7:
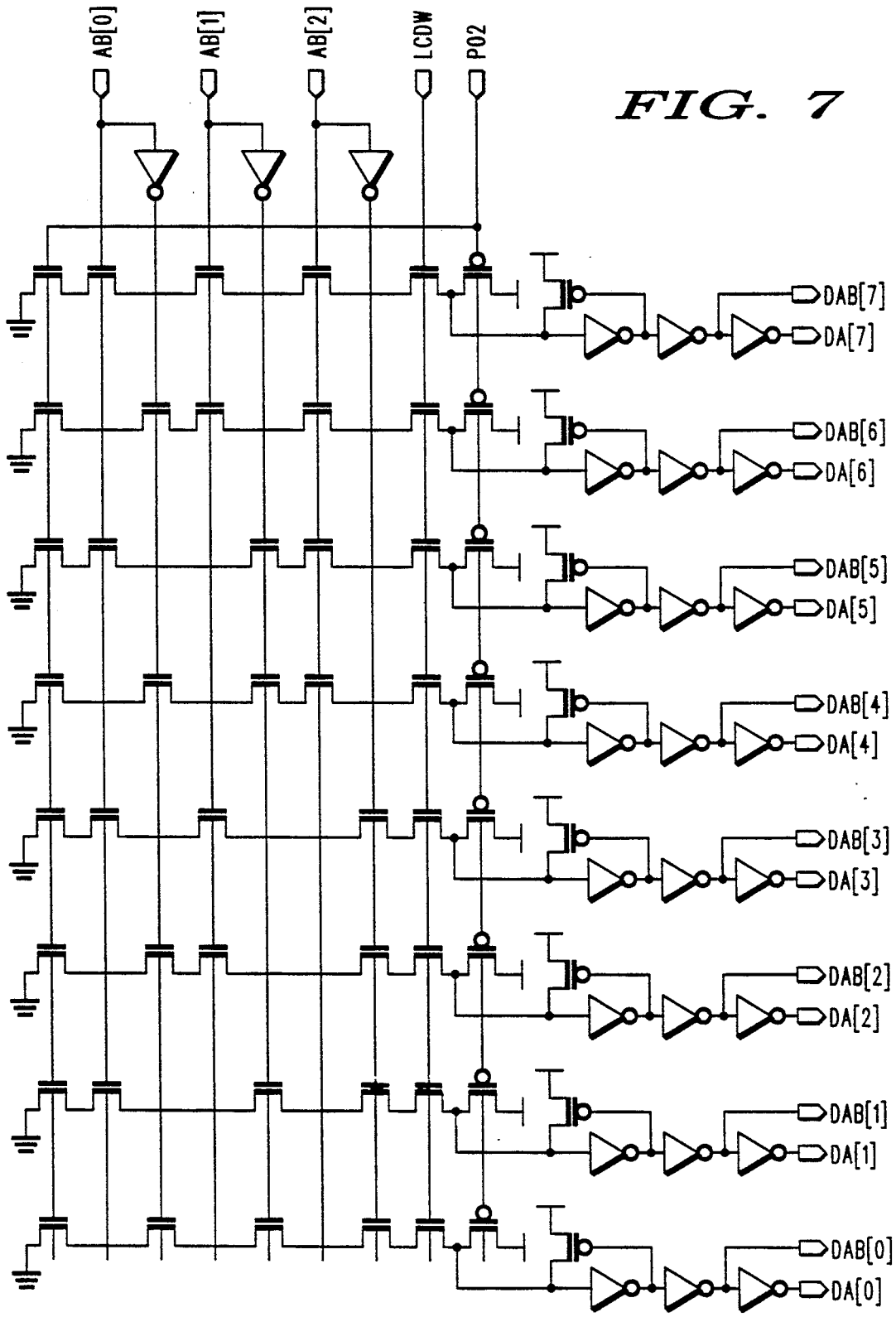
FIG. 7 illustrates a schematic diagram of the address decoder of FIG. 1 for a 256 segment LCD driver.

Address decoder 24 decodes core addresses from the MCU for dual-port buffer RAM 22 at the correct time according to bus clock signal PO2 and LCD buffer write signal LCDW from the MCU. The decoding is done with domino logic as will be apparent from the schematic diagram of address decoder 24 in FIG. 7. The right side of FIG. 7 illustrates a set of sense amplifiers and buffers. When clock signal PO2 is low, the inputs to the sense amplifiers are pre-charged to a high level. When PO2 is high, the inputs will be discharged if LCDW is low and the address conditions are met.

Figure 8:
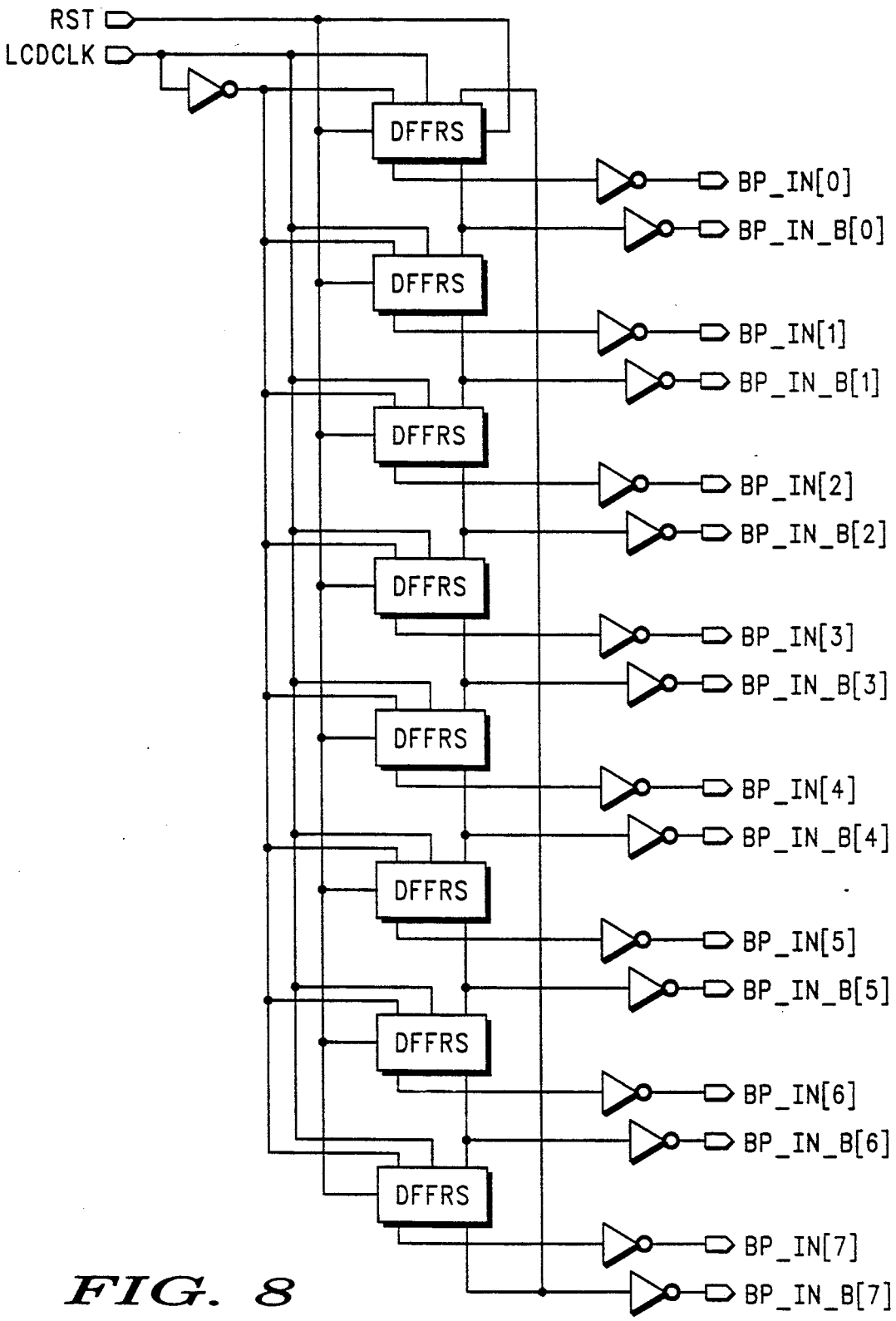
FIG. 8 illustrates a schematic diagram of the control logic circuit of FIG. 1, wherein the control logic circuit is constructed for 8 backplanes.
Figure 9A:
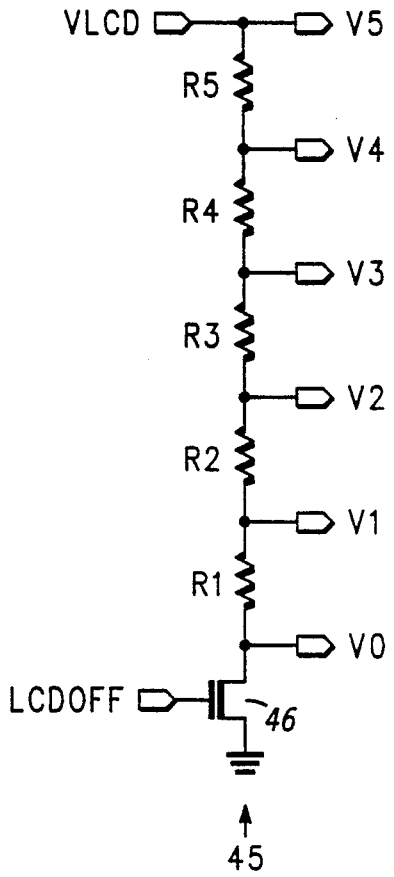
FIGS. 9 A–D illustrate schematically four available voltage ladders for use in the voltage generator of FIG. 1.
Figure 9B:
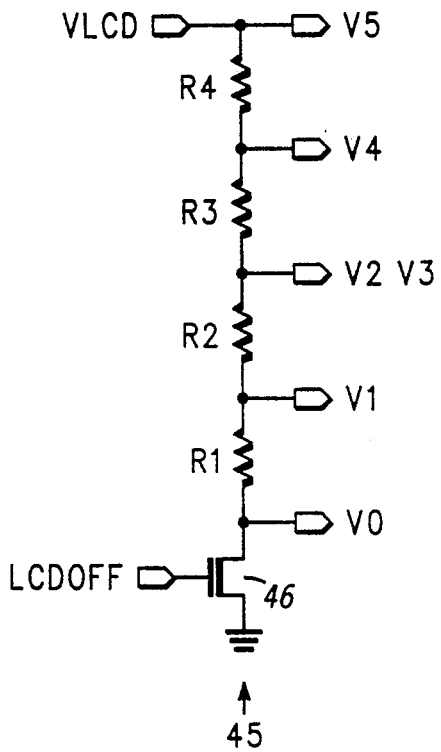
Figure 9C:
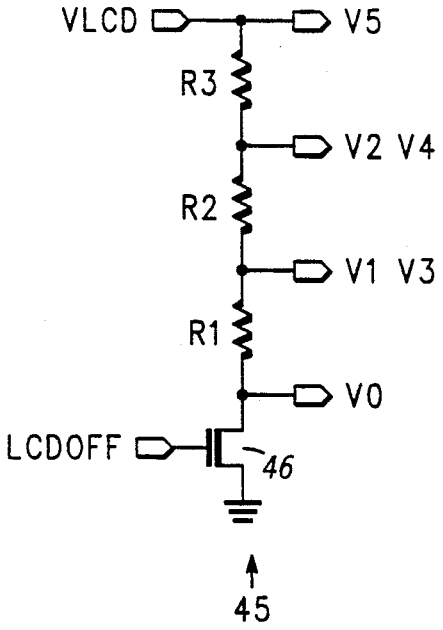
Figure 9D:
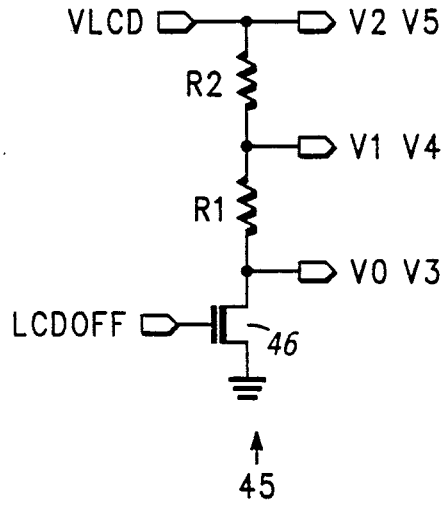

Control logic circuit 26, illustrated schematically in FIG. 8 is basically a shift register made up of D flip-flops, which utilizes external LCDCLK signals to generate the backplane signals, BP-IN, for dual-port buffer RAM 22 and backplane driver 34. The outputs from the flip-flops are buffered for driving address lines on dual-port buffer RAM 22. The whole LCD display is refreshed at a rate called the "frame frequency", which is derived from the external LCDCLK reference signal. The relationship is $$\text{frequency of LCDCLK} = \text{no. of backplanes} * \text{frame frequency}$$

$$\text{frame frequency} > \text{flicker frequency} \sim 20 \text{ to } 30 \text{ Hz}$$

A frame frequency of 60 Hz is recommended, and an increase in frequency increases the power consumption. The area occupied by control logic circuit 26 is not critically big so that standard library cells may be utilized in the layout. The transistors in the buffer portion of control logic circuit 26 are folded, i.e. each N and P transistor is duplicated horizontally. Also, the data and power buses are fed-thru the individual cells so that each cell can be accessed from either the left or the right side of the front end section block.

The voltage level references used by voltage generator 36 to compose the driver output waveforms in frontplane and backplane drivers 32 and 34 are generated in a simple resistor ladder 45, illustrated in FIG. 9. Both the number of voltage taps and resistor values are parameterizable, through "levels" and "r-ladder" parameters respectively, as is apparent from FIG. 9. Resistor ladder 45 has an NMOS transistor 46 at the bottom thereof connected to have an externally generated LCDOFF signal applied to the gate thereof. Transistor 46 can be switched off by the application of an LCDOFF signal to the gate thereof, so that no idle current is drawn in resistor ladder 45 when the LCD is off in a power saving mode.

Figure 10:
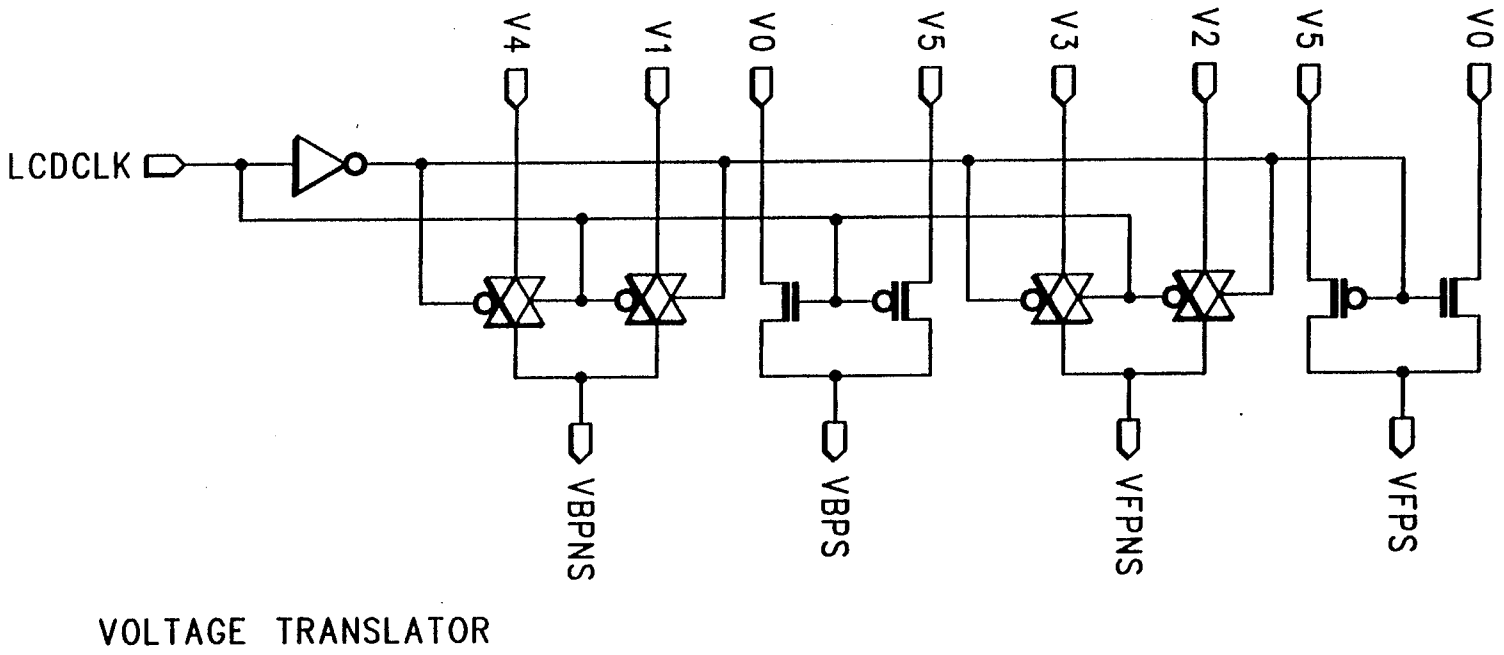
FIG. 10 illustrates schematically gates for use with one of the voltage ladders of FIG. 2 to produce a chosen set of select and non-select square waves for the LCD driver of FIG. 1.

In the voltage generator 36, a plurality of transmission gates and transistors, illustrated schematically in FIG. 10, are connected to resistor ladder 45 and utilized to compose square waveforms $V_{fps}$, $V_{fpns}$, $V_{bps}$ and $V_{bpns}$. Then in frontplane driver 30 and backplane driver 34 another set of transmission gates, illustrated in FIG. 11, multiplex these square waves to outputs. These two steps will be explained in more detail presently. In general, the main criterion in the construction of resistor ladder 45 is choosing the number of voltage levels to be implemented and the size of each level. More levels are needed for higher multiplexed drivers to obtain acceptable contrast in the LCD. For maximum contrast, i.e. maximum $V_{on}/V_{off}$, the following equation should be utilized:

$$\text{Levels} = 2 + \sqrt{\text{no. of backplanes}}$$

The recommended number of voltage levels for each multiplex ratio are listed below:

| no. of backplanes | 1 | 2 | 4 | 8 | 16 | 32 |
|---|---|---|---|---|---|---|
| multiplex ratio | static | 1/2 | 1/4 | 1/8 | 1/16 | 1/32 |
| no. of levels | 2 | 3 | 4 | 5 | 6 | (max.) |

If the user's choice of parameters is not recommended, the top level generator will flag a warning message but will still continue to generate the layout.

Waveforms with different voltage-biasing requirements are generalized to the six voltage levels case. Generally, more voltage levels are need to compose the waveforms for higher multiplexed LCDs, but it can be proven that at most six levels are necessary (provided the voltage levels need not be equally spaced). First, six pseudo-voltage levels ($V_0$, $V_1$, . . . $V_5$) are derived from a voltage reference (resistor ladder) according to the following relationships:

$$V_0 = 0$$

$$V_1 = V_{lcd}/a$$

$$V_2 = 2\ V_{lcd}/a$$

$$V_3 = (1 - 2/a)V_{lcd}$$

$$V_4 = (1 - 1/a)V_{lcd}$$

$$V_5 = V_{lcd}$$

where a = no. of levels—1.

Use of the above equations results in the levels listed in the chart below and the resistor ladder circuit 45 of FIG. 9.

| no. of levels | 3 | 4 | 5 | 6 |
|---|---|---|---|---|
| $V_0$ | 0 | 0 | 0 | 0 |
| $V_1$ | 1/2 | 1/3 | 1/4 | 1/5 |
| $V_2$ | 1 | 2/3 | 1/2 | 2/5 |
| $V_3$ | 0 | 1/3 | 1/2 | 3/5 |
| $V_4$ | 1/2 | 2/3 | 3/4 | 4/5 |
| $V_5$ | 1 | 1 | 1 | 1 |

Then intermediate square-wave signals, called frontplane and backplane, select and non-select signals ($V_{fps}$, $V_{fpns}$, $V_{bps}$ and $V_{bpns}$) are each generated by continually switching between two psuedo-voltage levels defined by the bold values in Table 1 and implemented in the circuit of FIG. 10, e.g. the $V_{bpns}$ signal is actually a square-wave alternating between the $V_4$ and $V_1$ psuedo-voltage levels.

| | | | $V_{fps}$ | | $V_{fpns}$ | |
|---|---|---|---|---|---|---|
| | | | $V_5$ | $V_0$ | $V_3$ | $V_2$ |
| $V_{bps}$ | $V_0$ | $V_5$ | $-V_5$ | $+V_5$ | $-V_3$ | $+V_3$ |
| $V_{bpns}$ | $V_4$ | $V_1$ | $-V_1$ | $+V_1$ | $-V_1$ | $+V_1$ |

Figure 12:
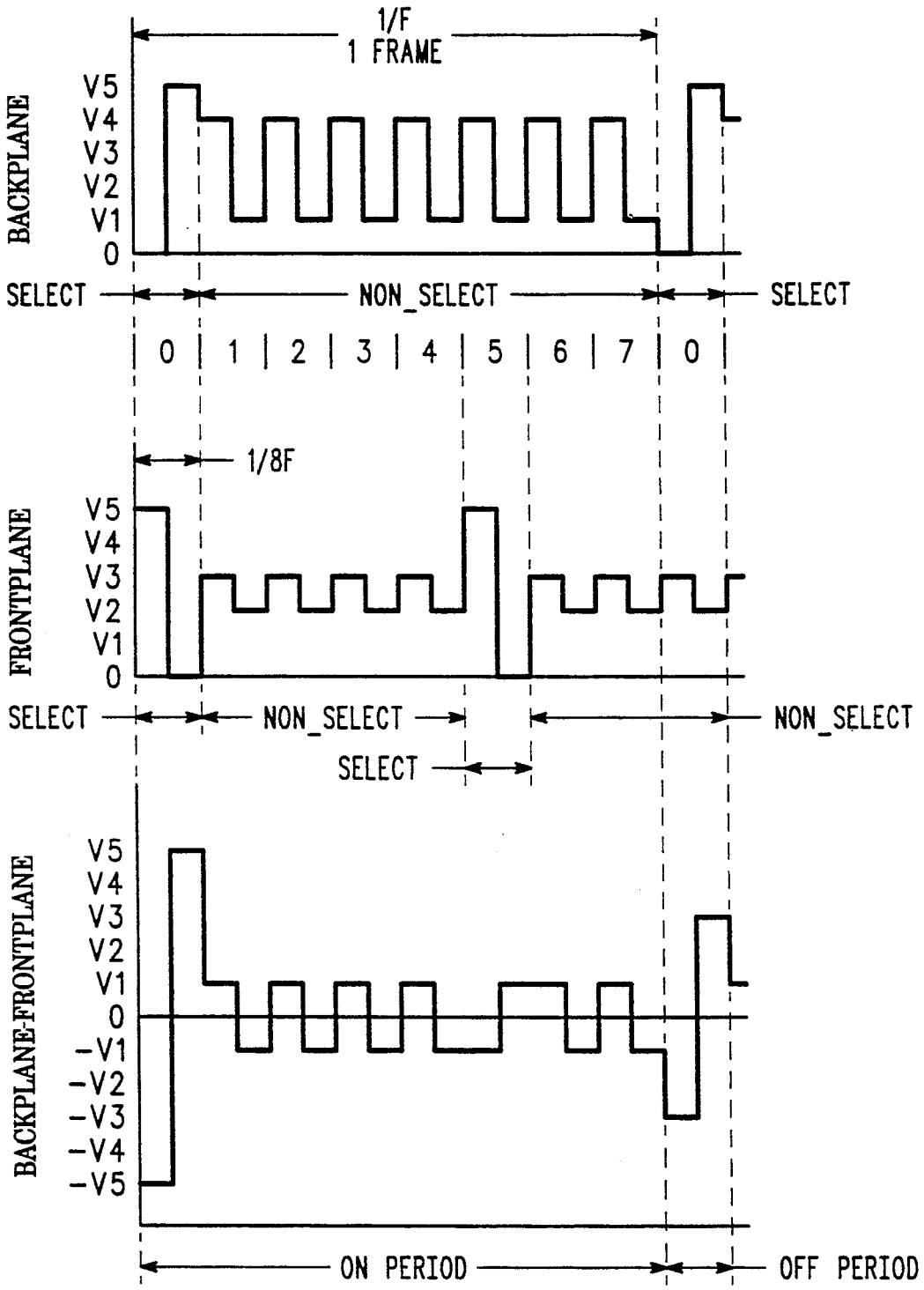
FIGS. 12 and 13 illustrate frontplane, backplane and combined waveforms which appear at the outputs of the frontplane drivers, the backplane drivers and across a specific segment of the LCD being driven by the driver of FIG. 1, when the LCD requires a 6-level driver and a 4-level driver, respectively.
Figure 13:
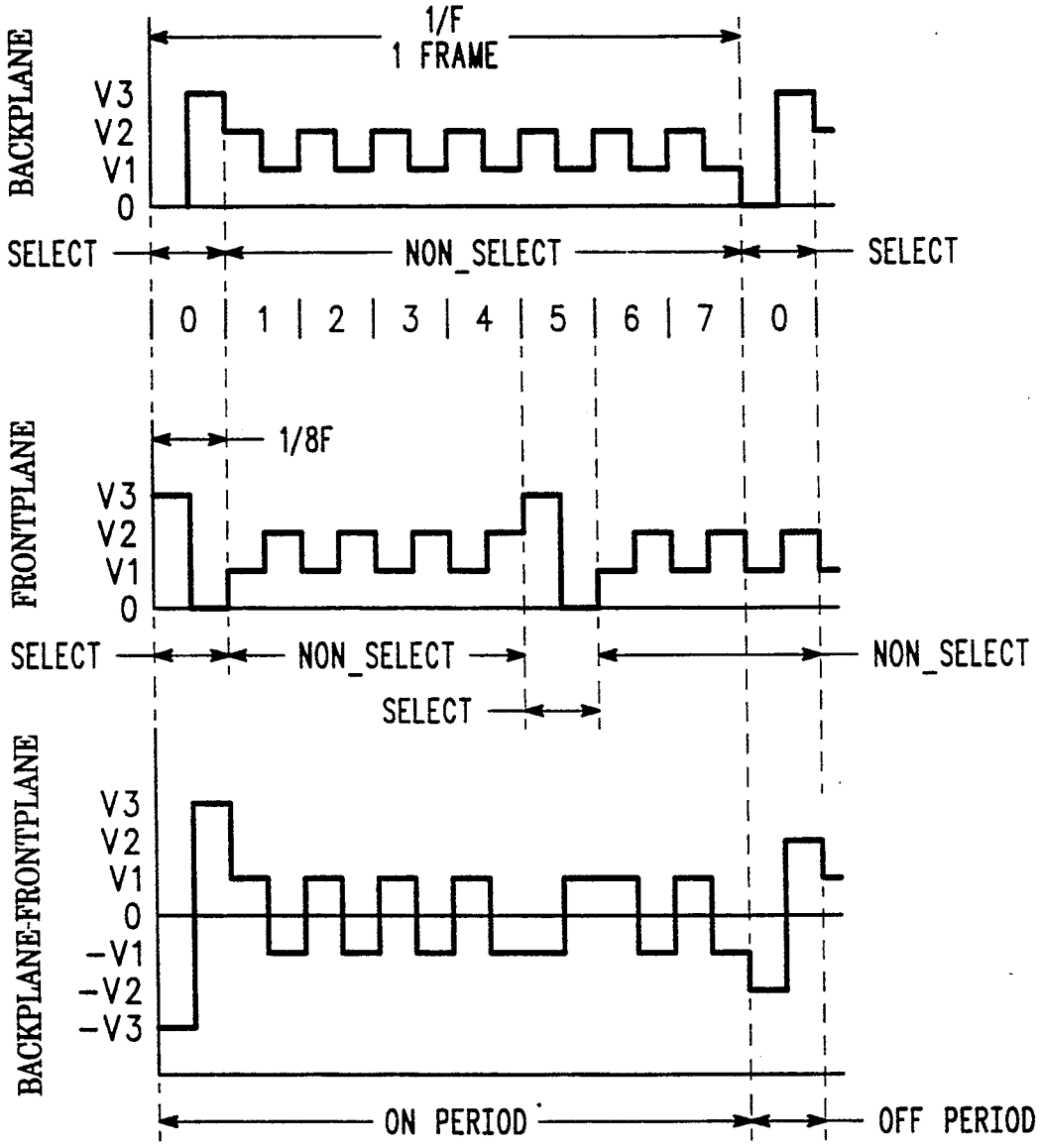

As shown in FIG. 12 and FIG. 13, a display frame is divided into 'backplane' number of time slots. During a particular time slot, the $V_{bps}$ signal is multiplexed to the corresponding backplane output while other backplanes are connected to the $V_{bpns}$ signal. For example on FIG. 3, backplane BP-IN[0] is multiplexed to $V_{bps}$ in time slot 0 but to $V_{bpns}$ during other time slots. Similarly, if a particular segment is to be turned on, the $V_{fps}$ signal is multiplexed to its frontplane output during its backplane time slot. Otherwise, the $V_{fpns}$ signal is multiplexed instead, e.g. segments at BP-IN[0] and BP-IN[5] of that frontplane will be turned on.

An LCD segment is sensitive to the voltage difference across its frontplane and backplane connections and will turn on if the R.M.S. voltage difference is above a specific threshold. With the above described driving scheme, the voltage waveform across a segment which is turned on (the junction of $V_{bps}$ and $V_{fps}$ in Table 1) will have $\pm V_5$ for its backplane time slot and $\pm V_1$ for other time slots. But for a segment which is off, one of its time slots will have $\pm V_3$ and others will have $\pm V_1$, and the resultant R.M.S. voltage is not high enough to turn on the segment. Another desirable property of the resultant waveform is that it is always alternating and has no d.c. component which can cause permanent damage to LCD displays.

In the prior art, if a designer wants to build an LCD driver with a particular bias voltage requirement, he has to re-layout the entire voltage generator circuit. Though the difference may not be great, he has to re-layout the resistor ladder and also re-route the interconnections between the ladder and the resistors. With the present generator development environment, which uses (in this specific embodiment) L-language procedural descriptions of electrical circuits, the above problems can be neatly solved with software. The interconnect variations illustrated in FIG. 9 A–D and FIG. 10 are incorporated into the generator as a table lookup from a data file. A P+ resistor ladder generator is constructed wich can generate ladders with different resistances and different numbers of taps, as illustrated in FIG. 9 A–D. The resistor fingers are arranged in such a way as to minimize resistance mismatch due to temperature gradient, etc. A pair of dummy fingers is included. Resistor ladder 45 is also a pad for the $V_{lcd}$ pin. The layout is programmed to be pitch matched to adjacent frontplane and backplane pad generator cells so that the power buses, the guard rings and the N-wells can be abutted together.

Frontplane and backplane drivers 32 and 34 include a second set of transmission gates, which generate the actual backplane and frontplane output waveforms supplied directly to the frontplane and backplane driver pads. Referring to FIG. 12, for example, the waveforms for a ⅛ multiplexed (8 backplanes) 6-level LCD driver are illustrated Waveform A is the output of backplane driver 34, waveform B is the output of frontplane driver 32 and waveform C is the difference between waveforms A and B, which appears across the specific LCD segment. FIG. 13 illustrates the waveforms for a ⅛ multiplexed, 4-level LCD driver. As described above, voltage generator 36 generates the frontplane select ($V_{fps}$), frontplane non-select ($V_{fpns}$), backplane select ($V_{bps}$) and backplane non-select ($V_{bpns}$) voltages and the frontplane and backplane drivers 32 and 34 simply multiplex the selected one of the generated voltages onto the driver output pads. It can be seen from FIGS. 12 and 13 that only simultaneous frontplane select and backplane select voltages on a segment results in sufficient voltage to activate the segment. Also, all other voltages result in an alternating voltage having a zero dc component being applied across the LCD segment.

Only one plane driver cell type, which is basically a multiplexing set of transmission gates illustrated schematically in FIG. 11, is need for both the frontplane and the backplane driver pads. As these transistors are connected directly to output pads, special design rules for pad areas apply. The following compiler techniques were used:

1. A "pad aux." file is set up to describe the various drawn dimensions of the bonding pads.

2. All bends in metal lines or nitride coming from the pad have to be drawn with angles of 45 degrees. A primitive library of these special pad transistors, contacts and multiplexers is first built and then called by the "driver-pad" sub-generator. This extra layer of primitive elements relieves the designer of the chore of adding rectangle and polygon patches.

3. When creating the driver pad, the generator knows the minimum pad diode protection area by the variable "min-diode-area" specified by the process layout design rules. Although the sizes of the N and P transistors are parameters to the driver pad sub-generator, they will only be used to generate the transistors if the diffusion formed by the transistor is bigger than the minimum diode area. As an alternative, transistors are generated according to the minimum diode area requirement.

4. Guard rings and isolators are added for latch-up prevention. A line of substrate or tie contacts may be specified in L-language with only one statement. Thus, it is much easier to port these pad generators to new technologies then doing it by hand-layout.

The LCD driver cell generator is designed to generate layouts and simulation models which drive a variety of 8-segments/digit LCD's. However, as stated before, the described generator and LCD driver can easily be modified to operate in other applications and with different interfaces and different numbers of segments/digit LCD's. The number of backplanes (multiplexing) can be parameterized to 2, 4, or 8. In addition, the present method can generate 3, 4, 5, or 6 level frontplane and backplane waveforms. The total number of LCD segments it can drive is specified through parameters. With the silicon compiler methodology, there is no upper limit from the layout point of view as to how wide the LCD driver can be but, from the timing point of view, the LCD driver is targeted to drive 32 frontplanes at its maximum. That is, with 2 backplanes, the maximum LCD segments it can drive is 64, with 4 backplanes it can drive 128 segments and with 8 backplanes it can drive 256 segments.

The generator module is designed with silicon compiler systems' Generator Design Tools (GDT). GDT supports both the top-down and bottom-up design methodologies. With GDT Lsim, circuit simulations (Lsim ADEPT mode) on the LCD driver have been done first with the dual-port RAM cell, then control logic circuit 26 and address decoder 24 and then with the whole front end section block. After getting the necessary timing information, the front end section block can be simulated in switch mode with the voltage generator and plane driver pads in ADEPT mode. In this Lsim mixed mode, simulation runs faster but retains sufficient accuracy.

Simulation on the layout is still too time consuming for simulating chip level designs where the LCD driver will only be a block in the design. So an LCD driver functional model is written so that in a typical customized MCU design, it serves as a functional model that can be linked to other functional models of the MCU core, RAM, ROM, etc.

The top level functional model lcd-n.M is built from two sub-models, front end-G.M and driver-G.M and the partition is illustrated in FIG. 1. The driver-G.M model uses Lsim analog simulation mode (with GET-VOLTAGE and SET-VOLTAGE statements) for reading and setting non-digital signals from the i/o pins. First the Vlcd voltage is read in, then the mapping of $V_0$–$V_5$ to $V_{fps}$, $V_{fpns}$, $V_{bps}$ and $V_{bpns}$ voltages is computed according to LCDCLK and the parameter "levels" as described above. Then the frontplane and backplane signals are set. In the front end-G.M, the dual-port buffer RAM portion is simulated with a memory array where the core data is consecutively placed but the frontplane outputs are taken from alternate locations on the array. The control logic circuit is modelled by a loop incremented every LCDCLK cycle.

Figure 14:
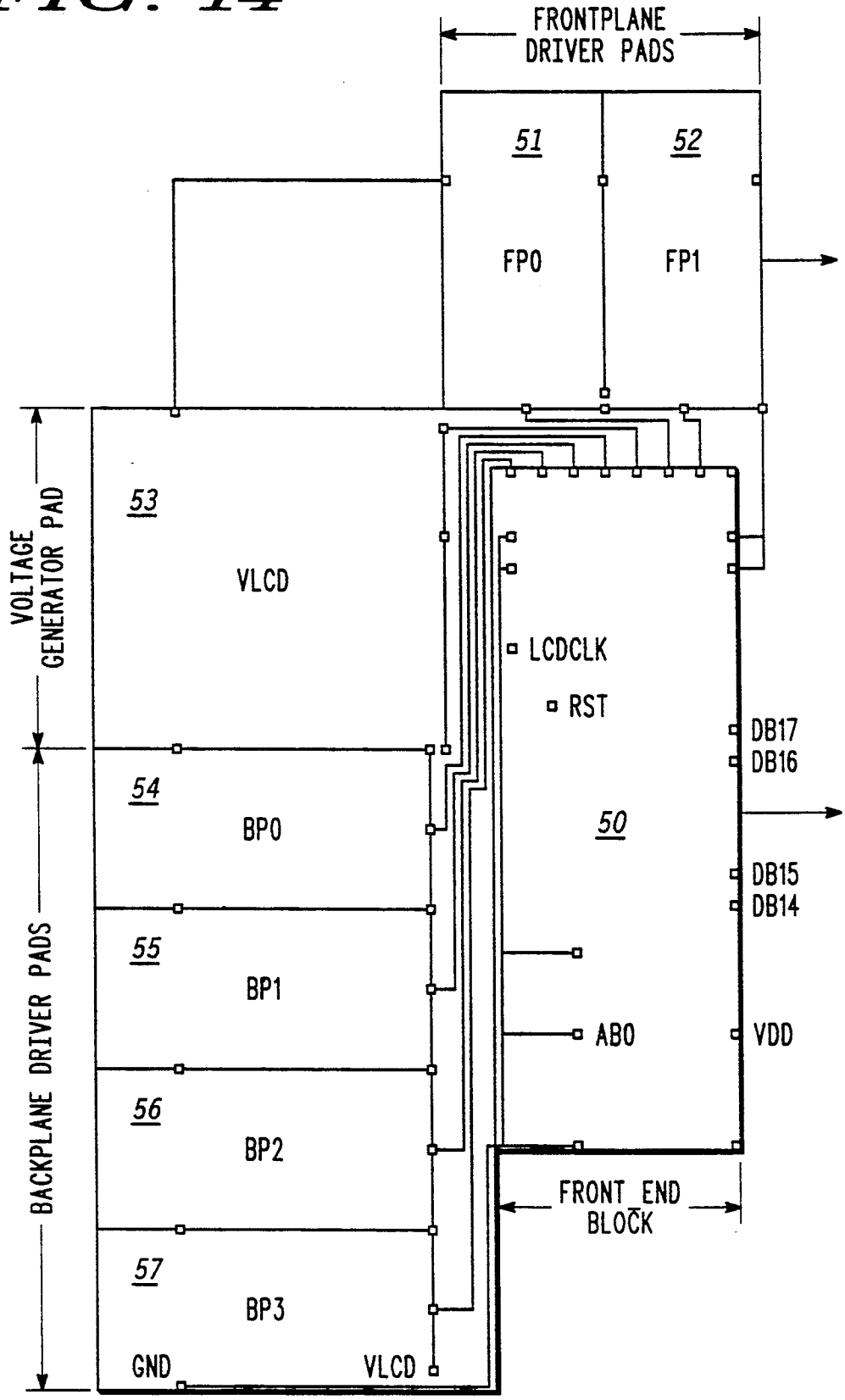
FIG. 14 is a top view of a layout of the LCD driver of FIG. 1 utilizing two frontplanes and four backplanes.

With simulation and generators properly completed, a layout of the LCD driver is generated. Referring to FIG. 14, a top view of a typical layout for the structure of FIG. 1 is illustrated. The particular LCD driver includes 2 frontplanes, 4 backplanes, 4 voltage levels and an r-ladder equal to 10 k ohms. A front end block 50 is positioned with two front plane driver pads 51 and 52 adjacent the upper edge thereof. A voltage generator pad joins driver pad 51 adjacent one corner thereof and four backplane driver pads 54 through 57 are positioned adjacent to voltage generator pad 53 and along one side of front end block 50. It will of course be understood that the front end block could be separated from the driver block if room on the chip does not permit the above configuration, or if a more convenient configuration is possible.

Generally, in the generation of a layout utilizing the present invention, the designer begins with a specific selected LCD, which determines the number of frontplanes and backplanes that must be used. The desired frame and clock frequencies are determined and the number and size of voltage levels are calculated. The various sub-generators are included in the software, according to the previous description. The LCD driver sub-generator calls hierarchy is illustrated in FIG. 15 so that a complete picture of the software that has been developed can be seen. Utilizing these generated layouts of the individual cells, the various components of the LCD driver are built and the entire structure is connected.

Figure 16:
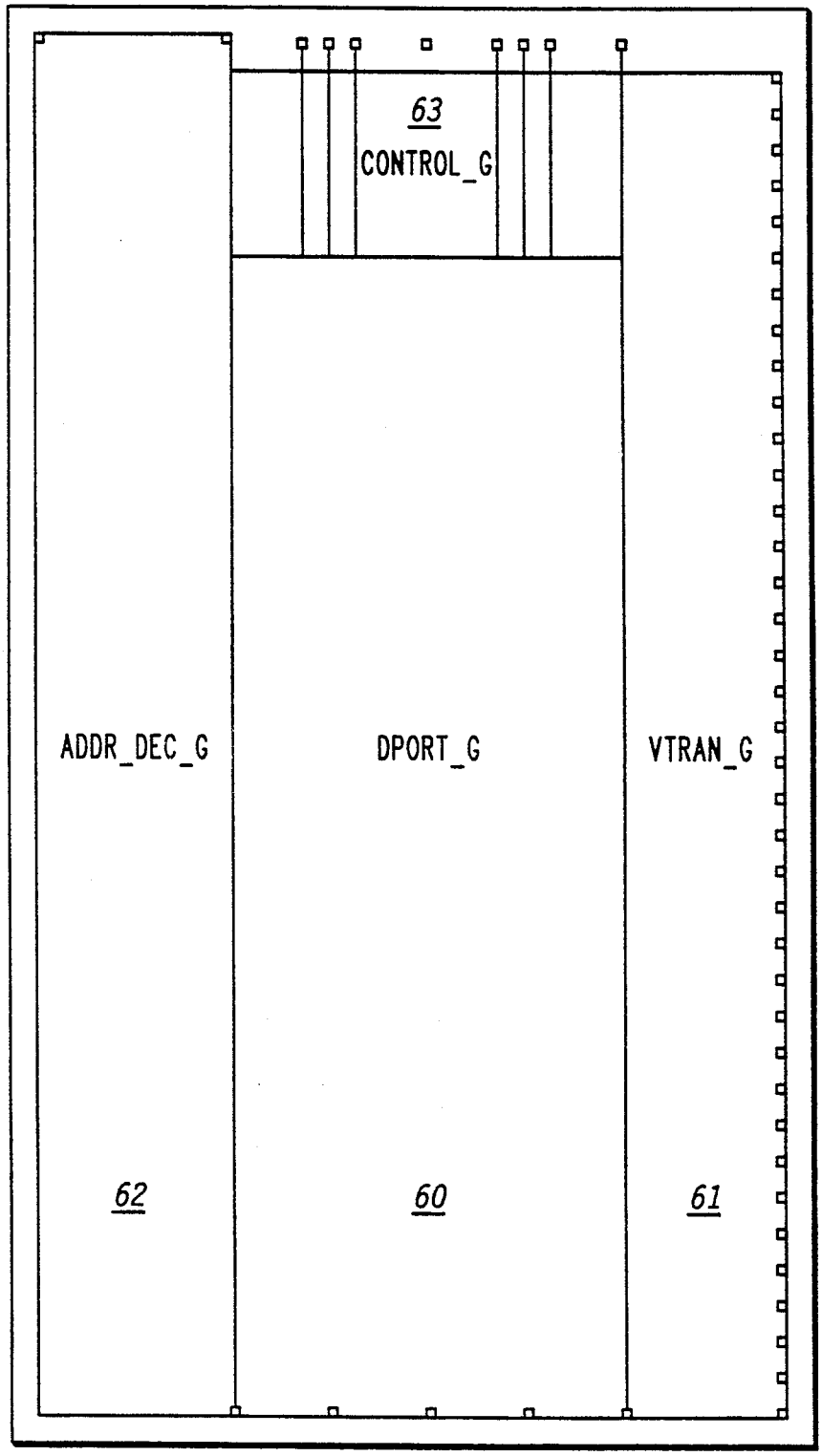
FIG. 16 is a top view of a partial layout of the front end of FIG. 1 utilizing 32 frontplanes and four backplanes.
Figure 17:
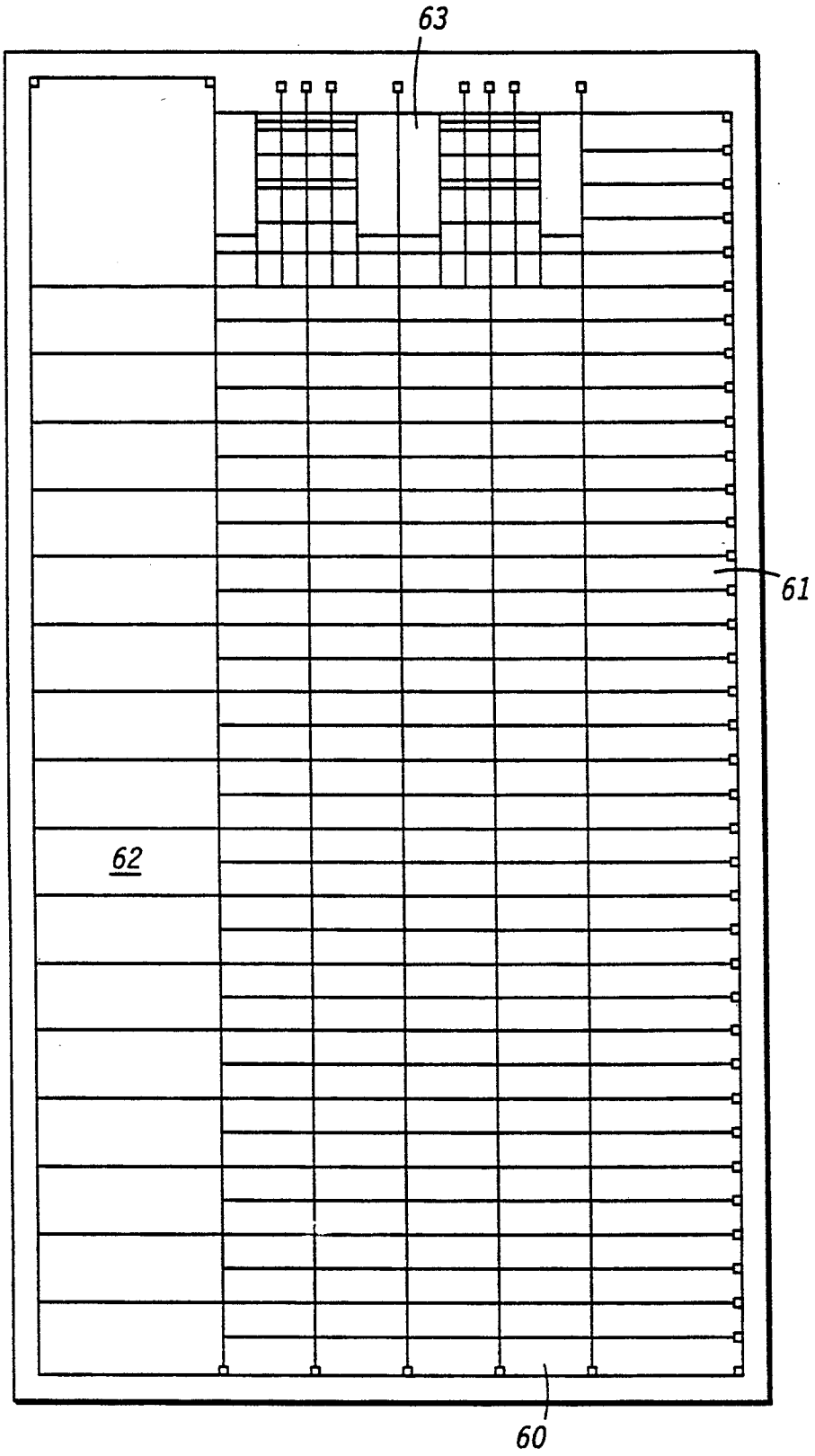
FIG. 17 is a top view of the complete layout of FIG. 16.
Figure 18A:
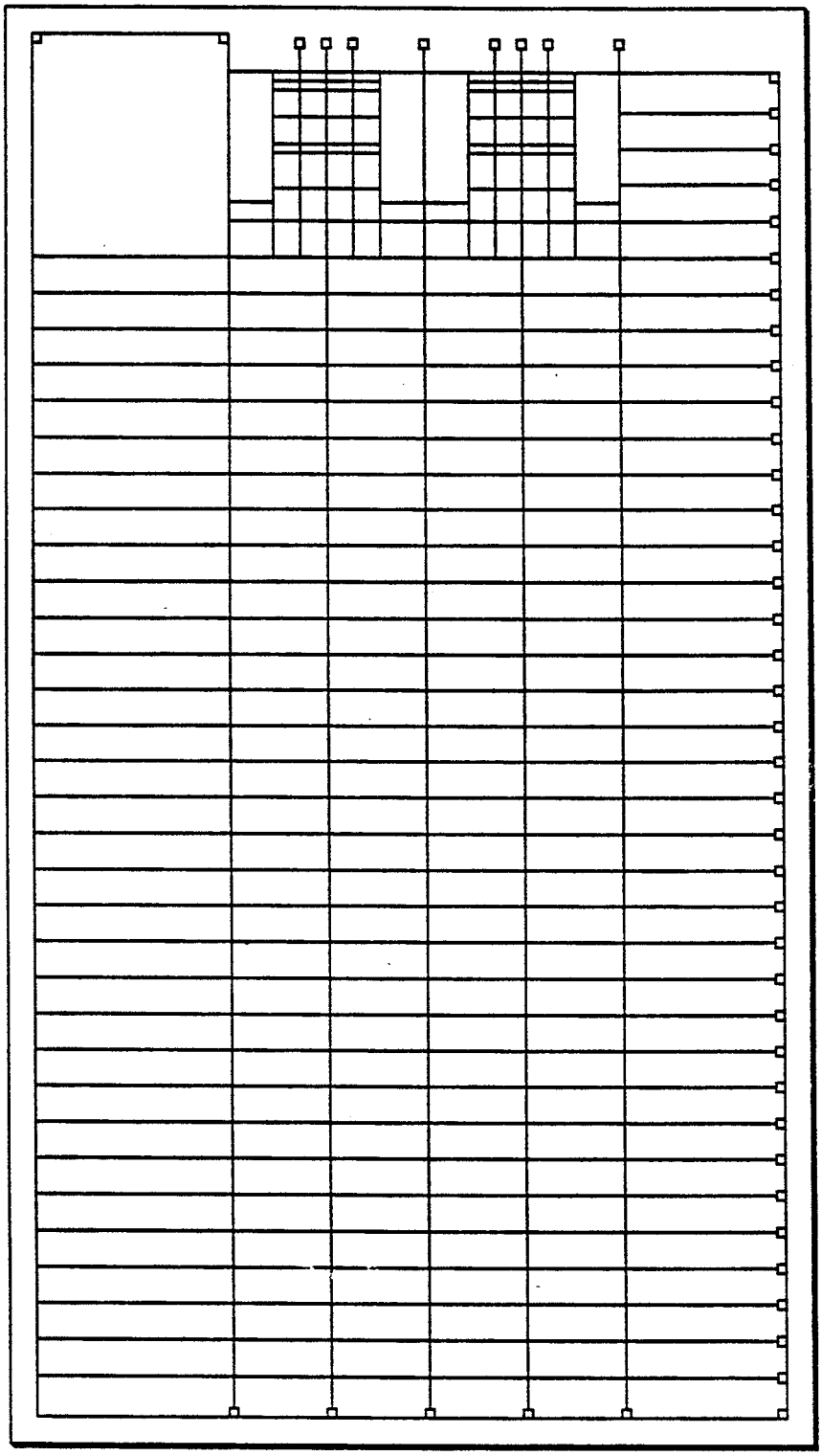
FIGS. 18A, 18B and 18C are top views of layouts of the front end section of FIG. 1 utilizing 32 frontplanes and 8 backplanes, 32 frontplanes and 4 backplanes and 16 frontplanes and 2 backplanes, respectively.
Figure 18B:
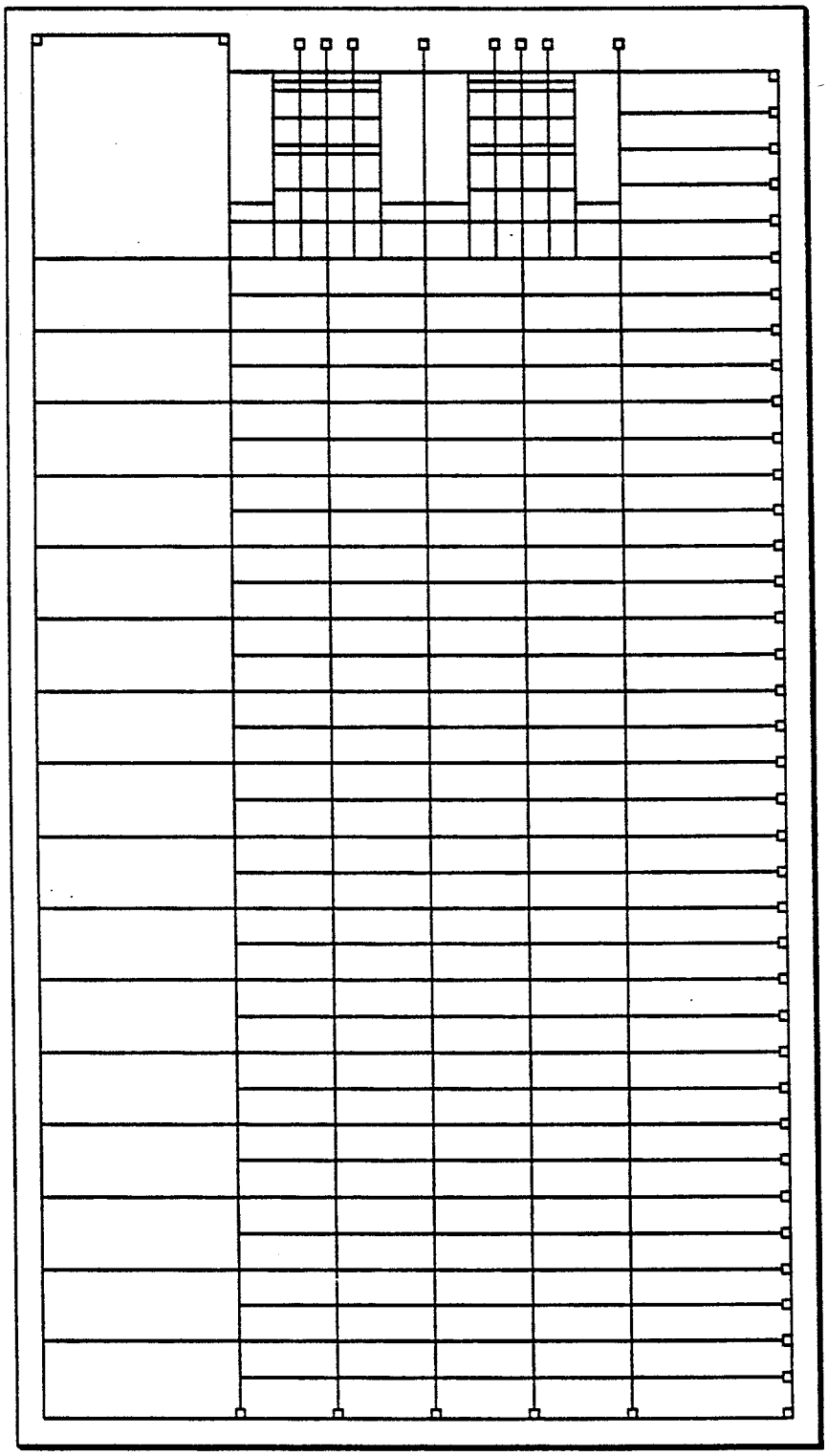
Figure 18C:
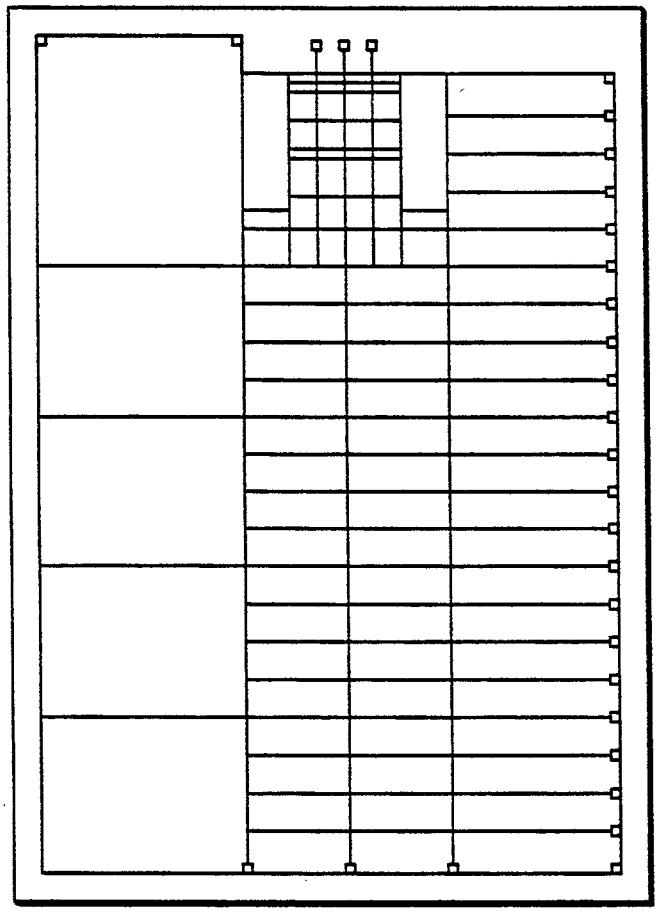

Referring to FIG. 16, a view in top plan is illustrated of a front end block which has been built as described above. This is an illustration of a partial layout of a front end block including 32 frontplanes and 4 backplanes. A complete layout of the cells for each of the components in the front end block is illustrated in FIG. 17. In this illustration, a dual-port buffer RAM 60 is positioned with voltage translators 61 along one side thereof and pitch matched thereto. Address decoder 62 is positioned along the other side of RAM 60 with the cells pitch matched to the cells of RAM 60. Control circuit 63 is positioned at the top of RAM 60 with the cells of control circuit 63 pitch matched to the cells of RAM 60. It can be seen that RAM 60 is built 32 cells high by 4 cells wide. Voltage translator 61 has 37 cells, 32 of which are pitch matched to the 32 cells of RAM 60 and 4 of which abut and connect to the BP-IN signal from control logic circuit 63 and the remaining one is for the BPCLK signal. The four cells of control logic circuit 63 are pitch matched to the four cells along the top of RAM 60. The 16 cells of address decoder 62 are pitch matched (2:1) to the 32 cells of RAM 60, along the left edge thereof. Similarly, FIGS. 18A–18C illustrate layouts of front end blocks (sections) having 32 frontplanes and 8 backplanes, 32 frontplanes and 4 backplanes, and 16 frontplanes and 2 backplanes, respectively.

Thus, a new and improved method of generating LCD drivers is disclosed, which method allows for altering the LCD driver for different LCDs and different applications. Further, a new and improved LCD driver is disclosed which can be adjusted to fit a variety of LCDs and differing applications. The present method is specifically designed to substantially reduce the amount of work required during design and layout of the LCD driver. Also, the amount of chip area is reduced by minimizing the cell area of similar cells.

While I have shown and described specific embodiments of the present invention, further modifications and improvements will occur to those skilled in the art. I desire it to be understood, therefore, that this invention is not limited to the particular forms shown an I intend in the appended claims to cover all modifications that do not depart from the spirit an scope of this invention.

What is claimed is:

1. A method of providing an IC layout for an LCD driver comprising the steps of:

selecting a specific type of LCD to be driven;

separating the LCD driver into a front end section including a RAM, address decoder and control logic, and a driver section including frontplane and backplane drivers and a voltage generator;

determining, from the selected specific type of LCD, the number of frontplane and backplane drivers to be included in the RAM;

selecting frame and clock frequencies;

determining a number of psuedo-voltage levels to be generated by the voltage generator using the equation $$\text{"Levels} = 2 + \sqrt{\text{no. of backplanes}}\text{"}$$

and determining the value of each psuedo-voltage level using the equations:

$$V_0 = 0$$

$$V_1 = V_{lcd}/a$$

$$V_2 = 2\ V_{lcd}/a$$

$$V_3 = (1-2/a)V_{lcd}$$

$$V_4 = (1-1/a)V_{lcd}$$

$V_5 = V_{lcd}$ where:

a = No. of levels—1; and

Vlcd = supply voltage applied to the driver section;

developing a resistor ladder to provide the determined voltage levels and gates to provide waveforms that will properly activate the selected LCD;

developing a layout of a driver cell and forming frontplane and backplane drivers from the driver cell layout;

developing a layout of a RAM cell, measuring the height and width of the RAM cell and forming a RAM from the layout of the RAM cell, with the RAM having a required number of RAM cells to provide information to selected backplane and frontplane drivers;

developing an address decoder for writing data in the RAM, said decoder including a plurality of decoder cells, with the decoder cells being pitch matched to one of the height and width of the layout of the RAM cells;

developing a control circuit including a plurality of control cells, with the control cells being pitch matched to one of the height and width of the layout of the RAM cells; and connecting all of the layouts of the components to produce an LCD driver IC layout.

2. A method of providing an IC layout as claimed in claim 1 including the steps of including voltage translators in the front end section and developing the voltage translators for making the operating voltage of the driver section compatible with the operating voltage of the front end section, the voltage translators being pitch matched to one of the height and width of the layout of the RAM cells.

3. A method of providing an IC layout as claimed in claim 1 wherein the steps of developing the layout of a RAM cell, developing an address decoder, developing a control circuit and connecting the layouts of all components is accomplished with the use of a silicon compiler.

4. A method of providing an IC layout as claimed in claim 1 wherein the step of developing the layout of a driver cell and developing frontplane and backplane drivers from the driver cell layout includes the step of designing the frontplane and backplane drivers for generating frontplane and backplane, select and non-select square-waves by continually switching between two psuedo-voltage levels as given by:

$V_{fps}$ switches between $V_5$ and $V_0$;

$V_{fpns}$ switches between $V_3$ and $V_2$;

$V_{bps}$ switches between $V_0$ and $V_5$; and $V_{bpns}$ switches between $V_4$ and $V_1$ where:

$V_{fps}$ = frontplane select square-wave;

$V_{fpns}$ = frontplane non-select square-wave;

$V_{bps}$ = backplane select square-wave; and $V_{bpns}$ = backplane non-select square-wave and multiplexing these square-waves to frontplane and backplane outputs.

5. An LCD driver for driving a selected LCD comprising:

a front end section including a RAM, address decoder, and control logic interconnected to provide operating signals, and a driver section including frontplane and backplane drivers with outputs and a voltage generator interconnected to each other and to said front end section and further connected to provide LCD driving signals;

the RAM including a plurality of frontplane columns and a plurality of backplane rows, the pluralities being chosen to provide a required number of signals to the selected LCD utilizing a reduced number of connections;

the voltage generator including a resistor ladder constructed to generate a plurality of psuedo-voltage levels in accordance with the equation $$\text{No. of levels} = 2 + \sqrt{\text{No. of backplanes in RAM}}$$

and the value of the voltage at each psuedo-voltage level corresponding to the following equations $$V_0 = 0$$

$$V_1 = V_{lcd}/a$$

$$V_2 = 2\ V_{lcd}/a$$

$$V_3 = (1 - 2/a)V_{lcd}$$

$$V_4 = (1 - 1/a)V_{lcd}$$

$$V_5 = V_{lcd}$$

where:

a = No. of level—1; and $V_{lcd}$ = supply voltage applied to the driver section; and said frontplane and backplane drivers being connected to receive the plurality of psuedo-voltage levels from said voltage generator and generating frontplane and backplane, select and non-select square-waves by continually switching between two psuedo-voltage levels as given by:

$V_{fps}$ switches between $V_5$ and $V_0$;

$V_{fpns}$ switches between $V_3$ and $V_2$;

$V_{bps}$ switches between $V_0$ and $V_5$; and $V_{bpns}$ switches between $V_4$ and $V_1$ where:

$V_{fps}$ = frontplane select square-wave;

$V_{fpns}$ = frontplane non-select square-wave;

$V_{bps}$ = backplane select square-wave; and $V_{bpns}$ = backplane non-select square-wave and multiplexing the generated square-waves to frontplane and backplane outputs.

6. An LCD driver as claimed in claim 5 including in addition voltage translators in the front end section constructed to translate operating voltages so that operating voltages of the driver section are compatible with operating voltages of the front end section.

7. An LCD driver as claimed in claim 6 wherein the RAM includes a plurality of similarly constructed cells alternately positioned to interconnect with a minimum length of connecting leads, the cells being positioned in rows and columns determined by the plurality of frontplane drivers and the plurality of backplane drivers.

8. An LCD driver as claimed in claim 7 wherein the voltage translators, the address decoder and the control logic are positioned adjacent to and pitch matched with the RAM cells.

* * * * *